United States Patent [19]

Dempsey et al.

[11] 4,247,376

[45] Jan. 27, 1981

[54] CURRENT COLLECTING/FLOW DISTRIBUTING, SEPARATOR PLATE FOR CHLORIDE ELECTROLYSIS CELLS UTILIZING ION TRANSPORTING BARRIER MEMBRANES

[75] Inventors: Russell M. Dempsey, Hamilton; Anthony B. LaConti, Lynnfield, both of Mass.

[73] Assignee: General Electric Company, Wilmington, Mass.

[21] Appl. No.: 491

[22] Filed: Jan. 2, 1979

Related U.S. Application Data

[62] Division of Ser. No. 866,299, Jan. 3, 1978, abandoned.

[51] Int. Cl.[3] ..... C25B 1/26; C25B 11/02; C25B 11/06

[52] U.S. Cl. ..... 204/128; 204/98; 204/258; 204/265; 204/266; 204/277; 204/289

[58] Field of Search ..... 204/128, 98, 282, 258, 204/266, 265, 277, 289

[56] References Cited

U.S. PATENT DOCUMENTS

| | | | |
|---|---|---|---|
| B 361,744 | 1/1975 | Gritzner | 204/128 X |
| 3,607,687 | 9/1971 | Grangaard | 204/277 X |
| 3,873,437 | 3/1975 | Pulver | 204/282 X |
| 3,893,897 | 7/1975 | Raetzsch et al. | 204/128 X |
| 4,013,537 | 3/1977 | White | 204/289 X |

FOREIGN PATENT DOCUMENTS 1148522 4/1969 United Kingdom .

*Primary Examiner*—Arthur C. Prescott
*Attorney, Agent, or Firm*—I. David Blumenfeld

[57] ABSTRACT

A unique, current conducting bipolar separator in a cell for electrolysis of chlorides makes multiple contact with the anodes and cathodes bonded to an ion transporting membrane in an electrolysis cell. Each side of the separator plate includes a plurality of electrode contacting, current conducting ribs or projections which also define a plurality of flow channels to allow fluid transport and good flow distribution. The projections or ribs on opposite sides of the separator plates are angularly disposed relative to each other so that the membrane is supported on one side by ribs of one separator and on the other side by the ribs from another separator which are angularly disposed to the first group. The intersection of the ribs on opposite sides of the membrane, thus, establishes a plurality of pressure areas or bearing surfaces which support the membrane without deforming it and without requiring very precise registration and alignment of the ribs.

31 Claims, 6 Drawing Figures

CURRENT COLLECTING/FLOW DISTRIBUTING, SEPARATOR PLATE FOR CHLORIDE ELECTROLYSIS CELLS UTILIZING ION TRANSPORTING BARRIER MEMBRANES

This is a division of application Ser. No. 866,299, filed 1/3/78, now abandoned.

This invention relates to an eletrolysis cell having current collecting separator plates, and more particularly, to an electrolysis cell having bipolar current collecting elements.

This application is a Divisional Application of our Application Ser. No. 866,299 entitled "Current Collecting/Flow Distributing, Separator Plate for Chloride Electrolysis Cells Utilizing Ion Transporting Barrier Membranes", filed Jan. 3, 1978.

Electrolyzers having a plurality of cell units, whether of monopolar or bipolar configuration, are well-known and widely used. There are numerous advantages in such arrangements in terms of space, savings, compactness, and particularly in the case of bipolar arrangements in facilitating the supplying of power to the electrolyzer by connecting the cell units in series. The individual electrolysis cell units in such an electrolyzer are separated from adjacent cell units by walls impervious to the electrolyte and reaction products. In the case of a bipolar cell arrangement, the separator allows internal electrical connection of the anode of one cell to the cathode of the adjacent cell. Existing separator or bipolar elements are fabricated of different materials. For example, steel was often used on the cathode side, whereas the anode side was cladded or otherwise covered with a material which is resistant to the feedstock, the anodic products and which can function as the catalytic anode. Because electrolysis occurs at the surface of these prior art bipolar cell separators, evolution of gases, particularly of hydrogen, at the separator surface, proved to be very troublesome. Hydrogen diffuses into the metallic substrates which make up the bipolar separator resulting in the embrittlement of the metal. Embrittlement of the metals due to the hydrogen diffusion often also results in the loss of the electrocatalytic materials deposited on the anodic side of the bipolar element. Many techniques and structures have been developed to avoid embrittlement of the bipolar separator structures. All of these solutions are expensive and many of them are only partially effective.

Two recent applications for U.S. Letters Patent, Ser. Numbers 858,942 and 858,959 both filed on December, 1977 and both abandoned, in the names of Anthony B. LaConti, et al and Thomas Coker, et al and respectively entitled "Chlorine Generation by Electrolysis in a Cell having a Solid Polymer Electrolyte with Bonded, Imbedded, Catalytic Electrodes of Hydrogen Chloride" and "Chlorine Production by Electrolysis of Brine in an Electrolysis Cell having Catalytic Electrodes Bonded to and Imbedded in the Surface of a Solid Polymer Electrolyte Membrane," (both assigned to the General Electric Company, the assignee of the present invention), describe processes and electrolysis cells in which the processes may be practiced, for electrolyzing aqueous chlorides such as aqueous hydrochloric acid and sodium chloride solutions. The solutions are electrolyzed in cells in which the anode and cathode electrode are in intimate physical contact with opposite sides of an ion exchanging membrane. This intimate contact is achieved by bonding the electrodes to the membrane and preferably by imbedding them in the surface of the membrane. Because of this intimate contact, the anolyte/catholyte voltage drop is reduced substantially as is the gas blending/mass transfer loss. As a result, the aqueous chlorides are electrolyzed very efficiently at cell voltages which represent 0.5 to 0.7 volt improvements over existing commercial systems.

Because the anode and cathode electrodes are bonded to an ion transporting membrane and are not separately supported on a rigid support structure, current conducting separator elements which make multiple, spaced contacts with the surface of the bonded electrodes have been found to be the most effective way for providing current conduction between the power source and the electrodes and for separating the cell units. In addition, applicants have found that the separator/current conductor can also be configured to provide good fluid transport and distribution for maximum fluid contact with the electrodes. In cells of the type described in the aforesaid LaConti and Coker applications, it is also desirable to support and restrain the membrane mechanically on both sides since the membrane is quite thin (in the order of 7 to 10 mils). The separator/current collector configuration of this invention further provides maximum membrane support at a plurality of locations without requiring careful spatial registration of the support elements on opposite sides of the membrane while also avoiding membrane deformation.

We have found that the electrolysis cells of the type described in the aforesaid LaConti and Coker applications may be made even more effective by utilizing a unique separator plate which is particularly adapted to be used in a bipolar configuration. The separator configuration is such that:

(1) It provides a sealing surface to the bare ion transporting membrane to prevent internal or external leakage. The sealing surface is made inert to the feedstock (hydrochloric acid in HC1 electrolysis and NaC1 in the case of brine electrolysis) and is preferably non-conducting to prevent unwanted parasitic reactions in the uncatalyzed membrane area.

(2) It makes good curent conducting contact with the catalytic electrodes attached to the ion transporting membrane; contact that is preferably independent of pressure used to seal the entire stack of cell units.

(3) It provides mechanical support to the bonded electrode/membrane structure at a plurality of locations withough risk of deforming the membrane.

(4) It promotes good mass transport allowing the chloride ions to reach the bonded electrodes and electrolysis product such as chlorine etc. to move rapidly from the electrode surface.

(5) It provides maximum current conducting contact at a plurality of locations with minimal masking of the electrode catalytic sites thereby minimizing parasitic oxygen evolving reactions.

It is therefore a principal objective of this invention to produce chlorine in electrolysis cells having separator plates which perform a current collecting/fluid distributing and membrane supporting function.

Another objective of this invention is to provide a bipolar electrolysis cell separator which functions only as a current collector, fluid distributor, and membrane support element and contacts the electrodes that produce the gaseous product.

Still another objective of this invention is to provide a separator plate for chlorine generating bipolar electrolysis cell assemblies in which the separators do not function as electrodes.

Other objectives and advantages of the invention will become apparent as the description thereof proceeds.

In accordance with the invention, electrolysis of chlorides such as hydrogen chloride and brine is carried out in cells or cell stacks which include one or more recessed graphite collector/separator elements. The recesses which form the anode and cathode chambers include a plurality of projecting ribs. The ribs contact catalytic electrodes bonded to an ion permeable membrane at a plurality of locations. The projecting ribs also define a plurality of fluid distribution paths. Each cell membrane is supported between two such collector/separator members. Ribs on opposite sides of a separator plate are angularly disposed to each other. Each membrane is supported on opposite sides thereof by the angularly disposed ribs which establish a plurality of pressure areas at their intersection to provide support for the membrane without requiring precise alignment or registration of the ribs. By virtue of this arrangement, graphite separator plates with ribs or projections provide excellent mechanical support of the membrane at a plurality of locations along the membrane and electrode surface. This results in good current conduction to and from the electrodes and good fluid flow distribution for feedstock and for electrolysis products.

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings in which:

Figure 1:
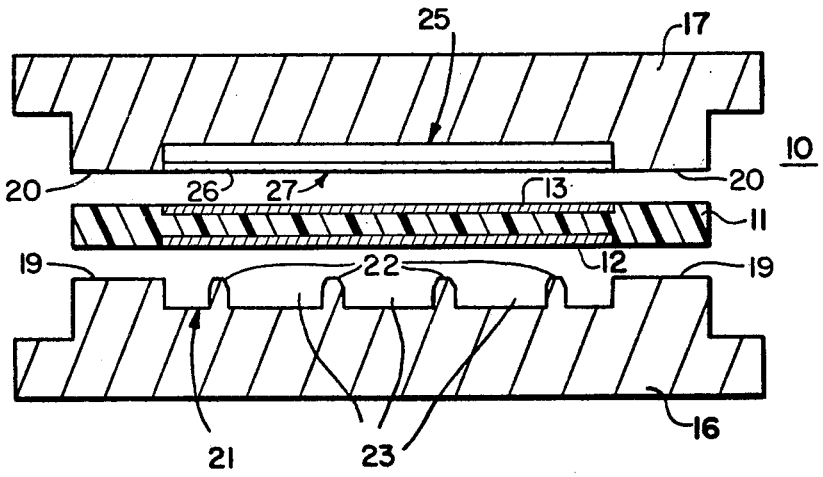
FIG. 1 is a diagrammatic exploded sectional plan view of a single cell in which a process for the electrolysis of chlorides can be carried out.

FIG. 1 shows a single cell unit 10 which includes a membrane 11 which transports ions such as cations but which is essentially impervious to liquids to prevent anolyte and catholyte transport between opposide sides thereof. Membrane 11 has an anode electrode 12 bonded to one side of the membrane and a cathode electrode 13 bonded to the other side of the membrane. The anode and cathode electrodes, as described in the aforesaid LaConti and Coker applications are themselves mixtures of noble metal electrocatalytic particles and a resinous material such as fluorocarbons marketed by DuPont under their trade name Teflon. Membrane 11 and bonded electrodes 12 and 13 are retained between a graphite, current collecting, fluid distributing, membrane supporting, anode endplate 16 and a graphite, current collecting, fluid distributing, membrane supporting, cathode endplate 17. Membrane 10 is firmly supported between endplates 16 and 17 by pressing the uncatalyzed surface portion of the membrane which extends beyond the electrodes between the sealing surfaces or flanges 19 and 20. The sealing surfaces should be inert to acid brine, chlorine, hydrogen and caustic and are preferably non-conductive. This prevents unwanted parasitic reactions from occurring in the uncatalytic membrane area which may adversely affect the membrane. To this end, the surfaces may be covered by an inert layer of material such as Teflon, Kynar, or the like.

Collector endplate 16 is recessed and defines an anode chamber 21 which includes a plurality of ribs or projections 22 which contact anode 12 in the assembled state. Ribs 22 define a plurality of channels 23 through which the anolyte and the evolved chlorine flows. Collector endplate 17 is also recessed and defines a cathode chamber 25. Cathode chamber 25 also has a plurality of ribs or projections 26 which, as shown in FIG. 1, are disposed in a horizontal direction. The cathode ribs or projections are covered by a conductive material such as a screen 27 or, preferably, a sheet of conductive material such as "graphite" paper. Thus, ribs 22 in the anode chamber and ribs 26 in the cathode chamber are angularly disposed to each other; in this instance at right angles.

These ribs being angularly disposed to each other also establish pressure or bearing areas at a plurality of locations on opposite sides of membrane 11, where the ribs intersect. In this fashion the membrane is firmly supported without requiring accurate registration of the ribs while avoiding or minimizing deformation of the membrane.

The projections illustrated in FIG. 1 extend essentially over the entire chamber. Such ribs are the preferred embodiment of the means to establish multiple current collecting points as well as multiple individual pressure areas for supporting the membrane. However, other configurations may be used in place of ribs. Such other configurations may take the form of dimples or projections or various cross sections such as cylindrical, elliptical, etc. which will also provide contact between the current collecting/distributing element and the electrodes bonded to the membrane.

Figure 2:
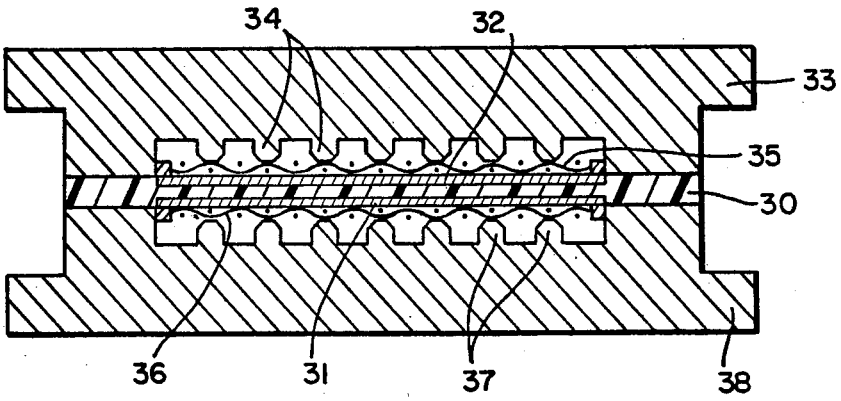
FIG. 2 is a diagrammatic sectional plan view of an assembled cell utilizing both metallic screen elements as well as collectors.

FIG. 2 illustrates a further embodiment of a single cell element with graphite current collecting/fluid distributing separator support element in which wire or expanded metal screens are disposed between the ribbed current collector and the anode and cathode electrodes bonded to the membrane. Thus, membrane 30 has an anode 31 and a cathode 32 in the form of electrocatalytic particles bonded with Teflon or other fluorocarbons bonded to or imbedded in the membrane 30. Graphite cathode current collector endplate 33 is again recessed to provide a cathode chamber which has a plurality of projections or ribs 34. Ribs 34 contact an expanded metal screen 35 which is positioned between ribs and cathode 32. Similarly, an expanded metallic screen 36 is positioned between graphite ribs 37 forming part of the anode chamber in graphite anode endplate 38 and anode 31.

Where expanded metal screens are interposed between the ribs of the current collector/fluid distributor element and the electrodes bonded to the membrane, the rib height is less than the depth of the anode and cathode chambers since the ribs do not contact the anode and cathode, but contact the screens which are pressed against the electrodes. Screens, of course, must be fashioned of materials which are electrically conductive but which are resistant to corrosion. Thus, the screen in the anode compartment should be resistant to the feedstocks such as HCl, NaCl as well as to the chlorine gas evolved there. Niobium or similar materials are suitable for use as anode screens. The cathode screen, may be of stainless steel or other metals in the case of hydrochloric acids electrolysis and of nickel or other materials which are resistant to caustic in brine electrolysis.

In HCl electrolysis the aqueous hydrochloric acid is electrolyzed at the anode to produce gaseous chlorine and by hydrogen ($H+$) ions. The $H+$ ions are transported across the membrane, which is cationic, to the cathode bonded to the opposite side of the membrane. The $H+$ ions are discharged at the cathode to produce gaseous hydrogen.

In brine electrolysis, an aqueous sodium chloride is brought into the anode chamber and water into the cathode chamber. Sodium chloride is electrolyzed at the bonded anode to produce chlorine gas and sodium ions ($Na+$). The sodium ions are transported across the membrane to cathode bonded to the membrane. The water at the cathode is electrolyzed to produce hydroxyl ($OH^-$) ions and gaseous hydrogen. The $OH^-$ ions combine with the $Na^+$ ions to produce caustic (NaOH). The water catholyte is also swept across the cathode surface to dilute the caustic formed at the cathode to minimize back migration of the sodium hydroxide across the membrane. Migration of NaOH to the anode results in a parasitic reaction in which the NaOH is oxidized to produce gaseous oxygen (which is highly undersirable) and water.

Figure 3:
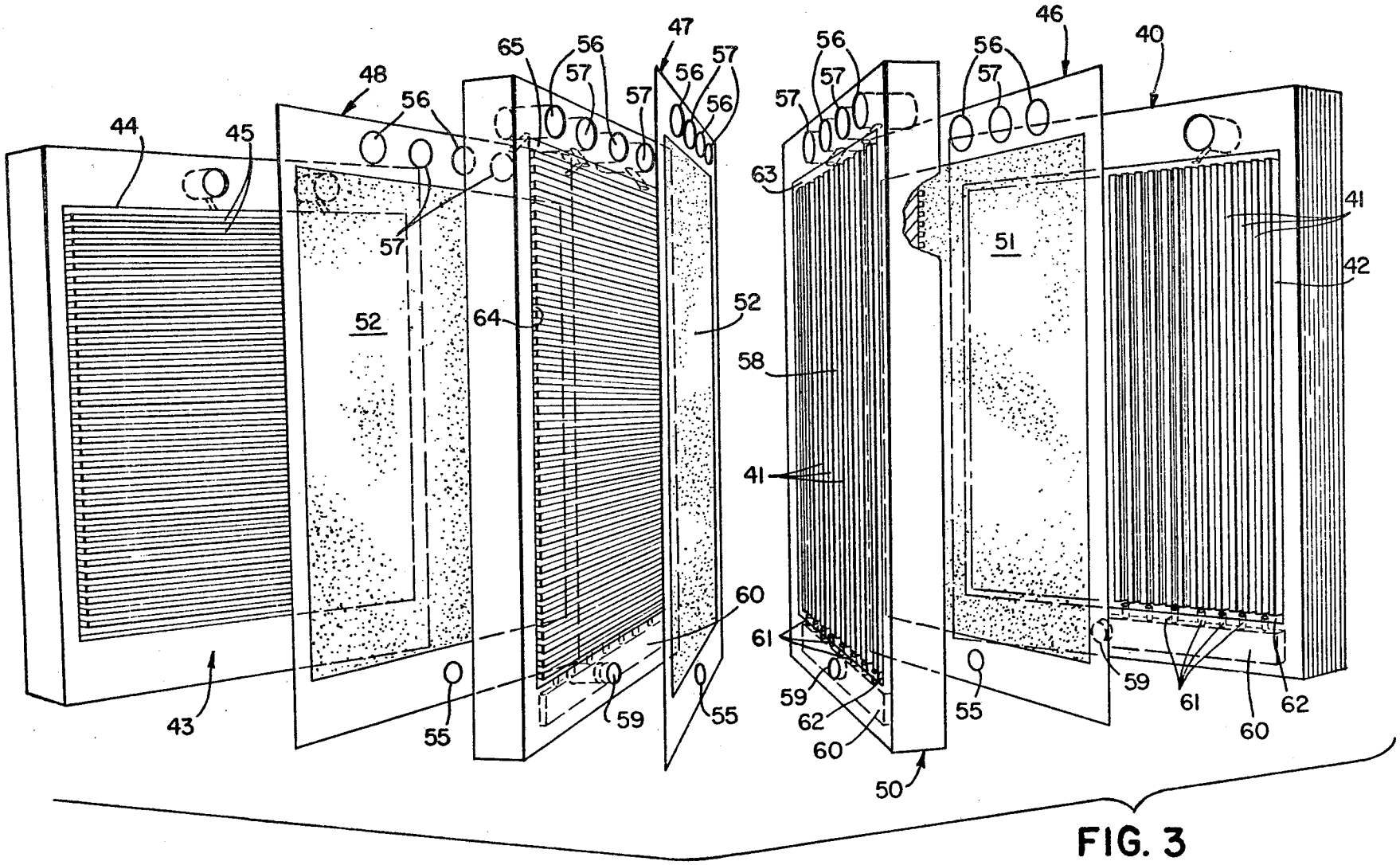
FIG. 3 is an exploded view of a multi-cell unit utilizing the separator/current collecting elements of the instant invention.

FIG. 3 is an exploded, perspective view of a multicell unit which includes endplates, grooved or ribbed separator plates, and a plurality of ion transporting membranes having catalytic electrodes bonded to the surfaces thereof disposed between the separator plates or between separator plates and endplates. The arrangement as shown in FIG. 3 is particularly useful in the case of bipolar electrolyzer assemblies in which a plurality of cells are connected electrically in series and in which the separator elements are bipolar. The ribs on opposite sides thereof are configured so that one side is an anode side current collector/separator for one cell while the ribs on opposite side is the cathode side current collector/distributor. The bipolar multicell assembly illustrated in FIG. 3 is one which may be used for hydrochloric acid electrolysis and includes a graphite, anode, current collecting and flow distributing endplate 40 having a plurality of vertical ribs 41 extending along the full length of recessed anode chamber 42. Ribs 41, as described previously, establish a plurality of channels for fluid distribution, i.e. for reach distribution of the feedstock such as hydrochloric acid and for the ready removal of the chlorine evolved at the anode. The assembly also includes a cathode endplate current collector/fluid distributor 43 which is recessed to form a cathode chamber 44. A plurality of horizontal ribs define a series of flow paths through which the hydrogen evolved at the cathode travels.

Disposed between endplates 40 and 43 are a plurality of ion transporting membranes 47, 47, and 48, separated by bipolar separator plates 49 and 50. Membranes 46–48 are capable of transporting ions and have layers of catalytic particles bonded to opposite surfaces thereof. Thus, membrane 46 has a cathode 51, which may typically be a bonded mixture of noble metal catalyst such as platinum black and hydrophobic fluorocarbon particles bonded to one surface. The opposite side of membrane 46, not shown, has an anode electrode consisting of layers of electrocatalytic particles bonded to the membrane. Anodes 52 and 53 may be seen bonded to membranes 47 and 48.

As pointed out in the LaConti and Coker application, the anode catalyst in the case of hydrochloric acid electrolysis is preferably a mixture of Teflon bonded graphite activated with a bonded mixture of noble metal catalytic particles and fluorocarbon particles. The noble metal catalysts are oxides or reduced oxides of Ruthenium, —stabilized by Iridium, Tantalum or Titanium. For brine electrolysis the electrode may be a bonded mixture of reduced oxides of noble metal catalytic particles such as Ruthenium, stabilized by reduced oxides of Iridium, Ruthenium-Titanium or Tantalum. The cathode electrodes may be of similarly electrocatalytic materials or may be bonded mixture of fluorocarbon particles and platinum black.

The membranes contain openings in the bare uncatalyzed portions thereof which are aligned with corresponding openings in the separator plates and endplates to permit feedstock to be brought into the chambers and to remove depleted feedstock and the electrolysis products. Thus, each of the membranes has openings 55 which communicates with inlet conduits 59 and a plurality of openings 56 which communicate with the anode outlet conduits and openings 57 which communicate with cathode outlet conduits.

The separator/current collector/fluid distributing-/membranes support elements 49 and 50 are recessed on both sides to provide anode and cathode chambers. The anode chambers on one side have ribs extending in a vertical direction (most readily seen in separator 50) and the cathode chambers on the opposite side (most readily seen in separator 49) have horizontal ribs.

In the case of a hydrochloric acid electrolysis cell, such as the one illustrated in FIG. 3, the aqueous hydrochloric acid feedstock is brought into anode chamber 42 in endplate 40 through inlet passage 59 which extends through the bottom of the endplate and through separators 49 and 50. The anode inlet passage 59 in endplate 40 and separators 49 and 50 communicate with a plenum or chamber 60 which extends along the entire width of the separator anode side. A plurality of vertical passages 61 on the anode side extend from chamber 60 to an open horizontal channel 62 which extends along the entire bottom end of the anode chamber. Channel 62 is open to the channels formed by the vertical ribs in the anode endplate chamber 42 and in the anode side chambers of separators 49 and 50. Anolyte is brought into chamber 60 under pressure. From chamber 60 to the anolyte passes into horizontal channels 62, through passages 61, and thence into the anode fluid distributing channels formed by the vertical ribs. The anode fluid distributing channels open into an upper horizontal channel 63 which communicates with anode outlet passages 56.

The horizontal flow channels in the cathode chambers of the separators and of endplate 43 open into vertical channels 64. Channels 64 opens into horizontal channels 65 which is connected through further passageways to cathode outlet passages 57. This permits removal of spent feedstock and chlorine at the anode and hydrogen at the cathode.

Figure 4:
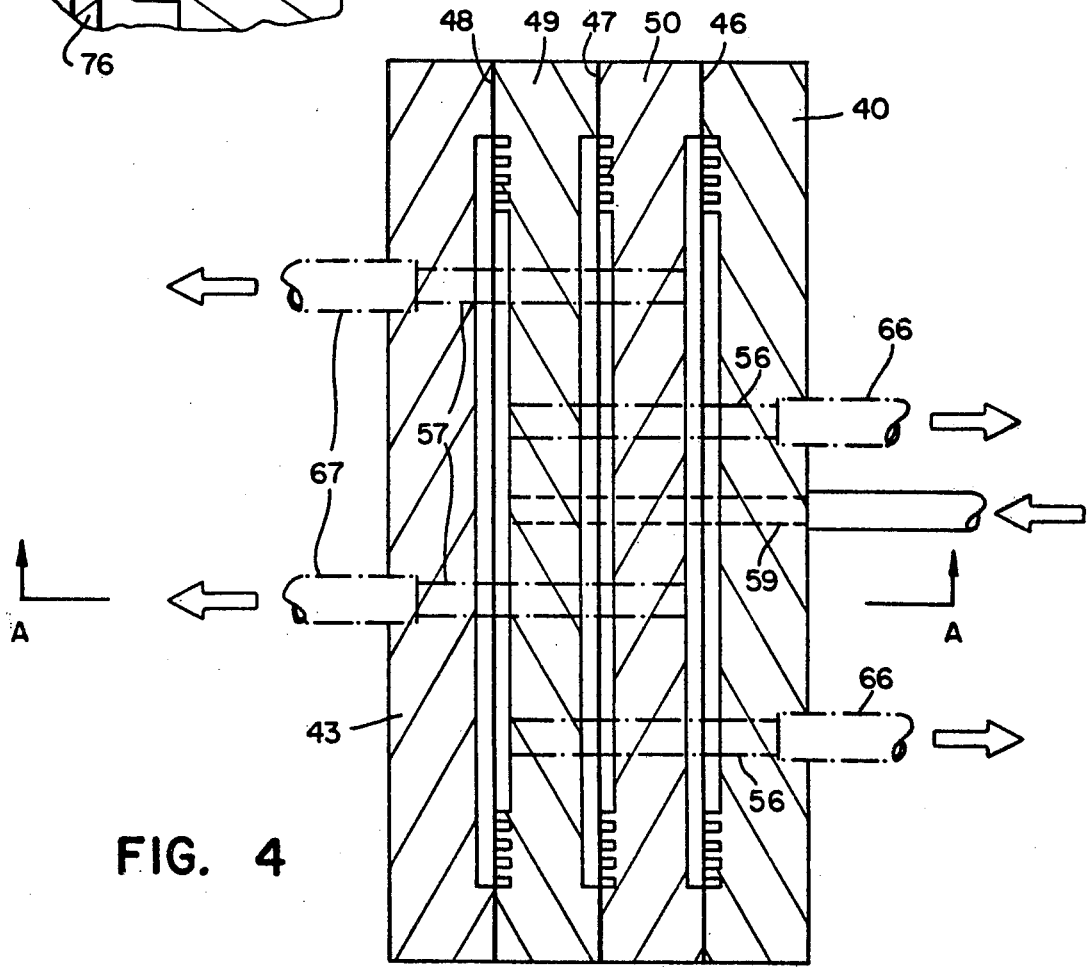
FIG. 4 is a horizontal sectional view through the assembly of FIG. 3 taken below level of the outlet conduits.

The manner in which the inlet and outlet conduits communicate with the individual anode and cathode chambers may best be seen in connection with FIG. 4 which shows a horizontal sectional view through the assembly of FIG. 3. The section shown in FIG. 4 is is taken below the level of the outlet conduit passages of the assembly of FIG. 2. Hence, the outlet passages and conduits are shown in phantom (dot-dash). The inlet conduit which communicates with the anode chamber is shown in dashed lines.

Thus, inlet conduit 65 communicates with the passage 59 in the separators and endplates and with openings 55 in the membranes. As pointed out previously, passage 59 communicates with chamber 60 and thence with the anode chambers so that the anolyte is brought into the individual anode chambers. A pair of anode outlet conduits 66 communicate with the individual anode chambers through a passage 56 to remove spent anolyte and chlorine gas. A pair of cathode outlet conduits 67 on the opposite side of the cell assembly communicate with the cathode chambers and passages 57 to remove hydrogen evolved at the cathode during the electrolysis of hydrochloric acid.

Figure 5:
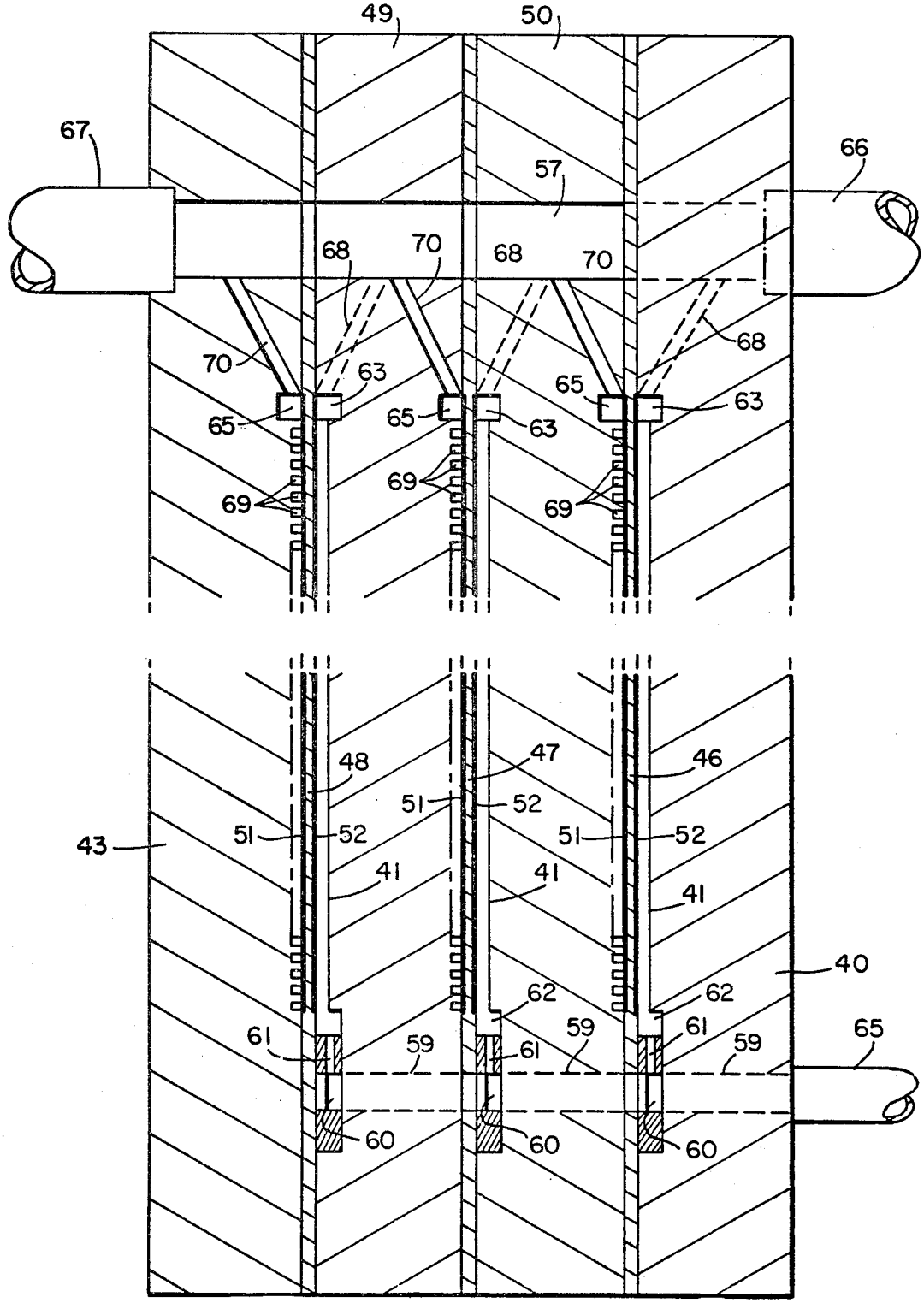
FIG. 5 is an enlarged vertical sectional view taken along lines A—A of FIG. 3.

FIG. 5, which is a vertical section taken along the lines AA of FIG. 4, shows these connections in greater detail. Thus, anode inlet conduit 65 is connected to chamber 60 through passage 59. Vertical passages 61 connect chamber 60 with channel 62 and thence into the fluid distributing channels formed by the vertical ribs 41. The anolyte is thus brought into contact with anodes 52 bonded to membranes 46–48. The upper horizontal channel 63 in the anode chambers communicate through passageways 68 with the anode outlet conduits 66. In the cathode chamber, the horizontal ribs shown generally at 69 communicate through passageways 70 and outlet openings 57 with cathode outlet conduit 67.

As pointed out previously, the arrangement illustrated in FIGS. 3, 4, and 5 shows a cell in which hydrochloric acid is electrolyzed so the electrolysis product on the cathode side of the cell is hydrogen. The hydrogen flows through the fluid distributing passages established by the horizontal ribs. No inlet conduit to the cathode chambers for introduction of a catholyte is required. However, if such a cell is to be utilized for brine electrolysis, a catholyte ($H_2O$) is introduced into the cathode chamber. In that case, an inlet conduit similar to anode inlet conduit 65 and a chamber similar to the anode chambers 60 is provided to bring the catholyte into the cathode chamber. These are not shown in FIGS. 3–5 in order to simplify the drawings. However, it will be obvious to those skilled in the art that such inlet conduits would have to be provided.

Figure 6:
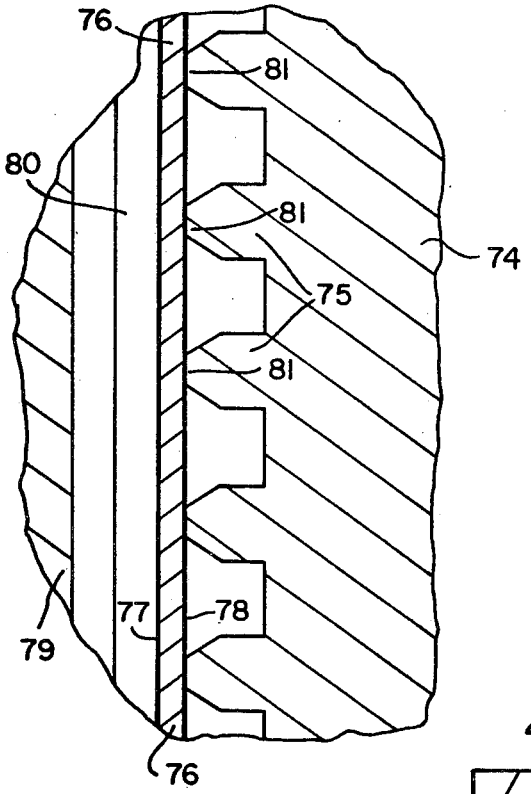
FIG. 6 is a partial sectional detail showing individual separator plates positioned on opposite sides of the cell membrane.

Furthermore, in brine electrolysis, where water and dilute caustic must also be removed from the cathode chamber, the cathode chamber ribs should not be horizontal as this would make removal of catholyte and non gaseous electrolysis products more difficult. The ribs should be so angled as to have a vertical component to facilitate removal of electrolysis products. The ribs on opposite sides of the separator, as pointed out previously, must also be angularly disposed to each other. If they were not, then it would be necessary to align the separator ribs on opposite sides of a membrane very accurately. If the registration is not exact, the membrane caught between the misaligned ribs may be deformed. By providing ribs which are angularly disposed with respect to each other, a plurality of bearing or supporting pressure areas are established on opposite sides of the membrane where the projected planes of the ribs interact spatially. This may be seen most clearly in FIG. 6 which shows an enlarged vertical sectional view to a portion of the ribbed or grooved sections on opposite sides of the membrane. Thus, it may be seen that a separator 74 having a plurality of horizontally extending rib projections 75 is pressed against one side of a membrane 76 having an anode 77 and a cathode 78 bonded thereto. A ribbed separator or endplate 79 with vertically extending ribs 80 is positioned against the opposite side of the membrane. A plurality of pressure exerting surfaces between the two electrodes are established at the points where the flat surfaces of ribs 75 shown for example at 81 press against ribs 80 of separator 79. Thus, a plurality of membrane support points are provided on opposite sides of the membrane.

Whenever the ribs or projections in each of the separators bear against the bonded electrodes on the surface of the ion transporting membrane, they provide desired current collection function as well as the fluid distribution, and the support of the membranes. However, it has been found that the current collecting ribs should have sufficient contact area to provide adequate current collection and to support the membrane without, at the same time, covering too much electrode surface area. Since the ribs are in direct contact with the electrode as shown at 81 of FIG. 6, and the feedstock is an aqueous solution of hydrochloric acid or brine, the chloride from the aqueous HCL solution is depleted rapidly at the anode and the remaining water can be trapped between the ribs and the electrode. By thus blocking the chlorides from the catalytic sites, water rather than chloride is electrolyzed. Since the current collector/separator/fluid distribution members are fabricated of graphite, they are susceptible to attack by oxygen, particularly nascent oxygen. Hence, the contact area of the current collector ribs must be adequate to provide good current conduction, while at the same time, avoiding excessive masking of the catalytic sites to avoid excessive oxygen evolution.

A number of experiments were conducted to show the impact of the contact area of the separator/current collector/fluid distributor on oxygen generation at the anode. The tests were carried out with separators having ribs or projections of various cross sectional surfaces thereby varying the contact area with the anode. The cell was operated as a hydrogen chloride electrolyzer with an aqueous hydrochloric solution and about 10 normal HCl brought into the anode chamber at a current density of 400 amp/sq ft., and an anolyte temperature of 30° C. and a cell voltage of 1.8 volts.

In the first of the experiments, three superimposed platinized, expanded niobium metal screens were positioned against the anode surface to distribute current. The oxygen content of the evolved chlorine was measured by means of a gas chromatograph and the oxygen content was found to be 0.01%. Metal screen current collectors thus provide very low oxygen evolution. However, the screens are not very cost effective for production manufacturing and are considerably more difficult to fabricate compared to the ribbed separators.

In a second experiment, a graphite separator/current collector plate was utilized and had rectangular ribs 0.045 inches high spaced 0.060 inches apart. The top of the ribs were flat and the width of these ribs was 0.060 inches. The oxygen content of the evolved chlorine was found to be 5.0%. The interposition of one Niobium metal screen of 0.010 inch thickness between the graphite separator and the anode reduced the oxygen content to 0.42% and the addition of yet another such screen reduced to 0.05%. It will be apparent that with a relatively wide rib surface, catalytic sites are masked, water seems to be trapped between the ribs and the anode resulting and the evolution of a significant quantity of oxygen. This oxygen evolution can be reduced somewhat by the interposing screens. However, these screens are very difficult to assemble in production manufacturing. Furthermore, they are expensive.

In Experiment 3, the rib configuration was changed to provide ribs with an upper tapered portion so that the anode contacting surface was substantially reduced. The total height of the ribs was approximately 0.05 inches; the ribs were separated by a distance of 0.060 inches. The anode contacting surface of the upper tapered portion of the type shown in FIG. 6 was reduced to 0.30 inches in width. The taper began approximately 0.025 inches from the base of the ribs. The distance from the base of the taper to the flat electrode contacting surface was 0.025 inches. With this configuration and the reduced electrode contact area, the oxygen content that resulted with a rib having twice the contact area (0.060 in). The oxygen content may be reduced further by interposing one or two Niobium screens. With one interposed screen, the oxygen contact was reduced to 0.37% and with two screens to 0.015%.

In yet another experiment, Experiment 4, the spacing between the ribs was increased with the contact area being less than that in Experiment 2 but slightly greater than in Experiment 3. Thus the total height of the ribs was 0.118 inches. The contact area was 0.04 inches and the rib spacing was 0.098 inches. With this configuration and these dimensions, the oxygen content was found to be 0.02%. By widening the gap between ribs as well as reducing the width, the relatively large $Cl_2$ bubbles are rapidly removed. Hence, there is little water trapped by the gas bubbles.

These experiments demonstrated that it is important for the current collectors to be as narrow as possible at the point of contact. They must be wide enough to provide good current conduction, while at the same time, minimizing water electrolysis to maintain evolution of oxygen below 1% by weight of the chlorine. Also, the distance between ribs should be kept minimal to provide good contact and support to the catalytic electrodes. The depth of channels must be sufficient to allow the effluent gas to escape and chloride ions to reach the electrode surface.

The separator/current collecting/fluid distribution plates are constructed to have minimal porosity. The graphite may be sealed with a resin or preferably molded graphite bonded with a resin binder. Some of the bonding resins used include phenolics, fluorocarbons, chlorofluorocarbns. The bonding resin found to be preferred is polyvinylidene fluoride sold under the trade designation Kynar by the Pennwalt Corporation. Kynar and graphite powder are blended to form a homogenous mix. The homogenous mix of the graphite powder and the resin binder is molded at temperatures ranging from 350° to 400° F. at pressures of 1,000 to 2,700 psi with the percent of the binder ranging from 10 to 25% by weight. One form of the graphite powder which may be readily utilized to form the separators is a graphite powder sold by the Stackpole Corporation under its trade designation A-905 graphite. An alternative form of graphite powder which has been found quite effective is one sold by the Union Oil Company under its trade designation Poco graphite. The separator should have minimum porosity in order to limit permeability of the hydrogen or chlorine through the separator in case of hydrochloric acid electrolysis. The electrical conductivity of the separator, on the other hand, should be very high in order to provide good current collection both in a monopolar and bipolar configuration.

A number of graphite separators were built in accordance with the foregoing parameters and the resistivity of the current/collector measured.

TABLE I

| Molding Temp. (°F.) | Molding Pressure (Psi) | % Kynar | Resistivity (ohm-inches) |
|---|---|---|---|
| 400 | 2670 | 23 | $2.3\ 10^{-3}$ |
| 400 | 1500 | 23 | $2.65 \times 10^{-3}$ |
| 400 | 1000 | 23 | $2.93 > 10^{-3}$ |
| 400 | 2000 | 18 | $1.71 \times 10^{-3}$ |
| 400 | 2000 | 15 | $1.48 \times 10^{-3}$ |

As may be seen from the above data, the resin molded graphite separator/current collector has excellent resistivity in ohm inches and will provide excellent current conductivity.

A tro cell bipolar electrolyzer was constructed having 1 $ft^2$ anodes and cathodes bonded to an ion transporting membrane with a ribbed separator and ribbed endplates. The rib configuration and dimensions were the same as in Experiment 4.

EXPERIMENT 4

| | | |
|---|---|---|
| Height | 0.118 in | Beginning of taper |
| Spacing | 0.098 in | 0.070 in (from |
| Contact | 0.040 in | base) |
| Width | | |
| Taper | 0.050 in | |

An aqueous HCl solution of 10.5 of normality at 40° C. was supplied to the anode chamber at a feedflow rate of 3,000 cc/min at variety current densities. The percent of oxygen in the chlorine and the cell voltage was measured to determine the operational performance of the cell using a current collector/separator of the type heretofore described.

Table II illustrates the results of this test.

TABLE II

| Current Density (ASF) | Cell Voltage Range | % $O_2$ in Chlorine |
|---|---|---|
| 100 | 1.46 | 0.03 |
| 200 | 1.66 | 0.05 |
| 300 | 1.75 | 0.07 |
| 400 | 1.83 | 0.15 |

As can be seen from the above data, very excellent performance is obtained in that the oxygen concentration even at 400 amp/sq ft is less than 0.2 percent. It will be seen that the cell voltages at the various current densities show a very efficient cell and a very voltage efficient process for the electrolysis of chlorides.

An eight cell bipolar electrolyzer stack was constructed having 1 $ft^2$ anode and cathode electrodes bonded to the membrane. The separator and endplate rib configuration was the same as that described in connection with the cell of Table I. An aqueous HCl solution of 8.5 normality was supplied at a feed rate of 4000 cc/min at 40° C. at various current densities. Table III shows the cell voltages.

TABLE III

| Current Density (ASF) | Cell Voltage (v) Range (Avg) |
|---|---|
| 100 | 1.30–1.38 (1.34) |
| 200 | 1.47–1.59 (1.53) |
| 300 | 1.63–1.76 (1.70) |
| 400 | 1.73–1.91 (1.83) |

As may be seen, very excellent performance is provided with good current collection and low voltage drop.

It will also be apparent that in the arrangement described herein the separator/current collector/flow distributing, etc. element not only performs well but has the additional advantage of obviously being much less costly than the bipolar separator plates hitherto utilized in electrolysis which use extremely expensive materials such as Niobium, Tantalum, etc. Graphite is relatively inexpensive, the process for fabricating the separator, namely molding, is also relatively inexpensive, so that substantial economic advantage is gained by the use of the separator described and claimed in the instant invention.

While the instant invention has been shown in connection with certain preferred embodiments thereof, the invention is by no means limited thereto since modifications of the instrumentalities employed and of the steps of the process may be made and still fall within the scope of the invention. It is contemplated by the appended claims to cover any such modifications as fall within the true spirit and scope of this invention.

What is claimed as new and desired to be secured by Letters Patent of the United States is:

1. A process of generating chlorine which comprises electrolyzing an aqueous chloride between an anode and a cathode separated by an ion transporting membrane, the anode and the cathode each comprising a mass of electroconductive catalytically active particles bonded to said membrane, and having a current distributor in contact with the anode at a plurality of contact areas distributed over the surface of the anode.

2. The process of claim 1 wherein the contact area between the current distributor and the anode is small enough to limit water electrolysis at tne anode to a level which maintains the oxygen content in the chlorine evolved at the anode below 5 percent by weight.

3. The process of claim 1 in which the process is carried out having a current distributor in contact with the cathode.

4. The process of claim 1 wherein an aqueous solution of hydrochloric acid is electrolyzed at the anode.

5. A process of generating a halogen which comprises electrolyzing aqueous halide between an anode and a cathode separated by a gas and liquid impervious ion transporting membrane, with said anode being bonded to the membrane, applying an electrolyzing potential to said anode through a current distributor in contact with the bonded anode at a plurality of spaced contact areas, said areas being small enough to maintain the oxygen content of the evolved chlorine below 5% by weight.

6. The process according to claim 5 wherein the anode is bonded to the membrane and the membrane is a cation transporting membrane.

7. A method of generating halogen which comprises electrolyzing an aqueous halide between anode and cathode electrodes separated by an ion transporting membrane, with at least one of said anode and cathode electrodes being bonded to the membrane, supplying potential to the bonded electrode current distributor elements connected to a potential source and in contact with a plurality of spaced areas of said bonded electrode, exposing the areas of said bonded electrode between the plurality of spaced areas to an electrolyte.

8. The method of claim 7 wherein the distributor elements extend from a graphite backwall which is spaced from the electrode to provide passage of aqueous chloride between the backwall and the anode.

9. The method of claim 7 wherein the anode is bonded to the membrane.

10. The method of claim 7 wherein the contact areas of graphite collectors engaging the anode are small enough to hold the oxygen content of evolved chlorine below 5% by volume.

11. A method of claim 7 wherein both anode and cathode are bonded to opposite sides of the membrane and graphite distributor elements engage the anode and other graphite distributor elements engage the cathode.

12. The method of claim 10 wherein halogen generation takes place in a plurality of adjacent cell units and the graphite back wall separates a pair of adjacent units with graphite distributors extending from the back wall to the anode of one unit and graphite distributors from the other side of the back wall to the cathode of an adjacent unit to apply potential to the electrodes of adjacent units.

13. The method of claim 7 wherein the bonded electrode comprises nobel metal particles bonded with a polymeric fluorocarbon.

14. A method of generating chlorine which comprises electrolyzing an aqueous chloride between an anode and a cathode electrode separated by a thin gas and liquid impervious ion transporting membrane at least one of said electrodes being bonded to said membrane, applying potential to said electrodes, flowing spaced, individual, parallel streams of aqueous chloride over the surface of the bonded anode electrode on the side thereof remote from the membrane to which it is bonded, collecting chlorine from said stream, and flowing separate individual streams of aqueous medium along the cathode on the cathode side remote from the membrane.

15. The method of claim 14 wherein the anode is bonded to the membrane.

16. The method of claim 14 wherein the cathode is bonded to the membrane.

17. The method of claim 14 wherein both anode and cathode are bonded to the membrane.

18. The method of claim 14 or 17 wherein the streams are spaced by intermediate current distributors which bound the streams and extend from a potential source into electrical contact with the anode and cathode.

19. The method according to claim 14 or 17 in which the direction of flow of the anode streams is at a transverse angle with respect to the direction of flow of the cathode streams.

20. The method of claim 18 wherein the areas of contact of the anodic distributors are small enough to maintain the oxygen content of evolved chlorine below 5 percent by weight.

21. The method of claim 18 wherein the anode comprises a catalytic noble metal and the distributors comprise graphite.

22. The method of claim 7 wherein potential is supplied to the bonded electrode through a plurality of spaced graphite current distributor elements.

23. An electrolysis unit comprising a plurality of cells connected electrically in series, each cell having:

(a) an ion transporting membrane, (b) electroconductive catalytic anode and cathode electrodes bonded to and supported by said membrane, (c) bipolar current collecting, flow distributing elements separating individual membranes of each cell from adjacent membranes, said bipolar elements including spaced, conductive projections extending from opposite sides thereof, whereby projections on one side of said element define an anode chamber and contact the anode electrode bonded to one membrane and the projections on the other side define a cathode chamber and contact the cathode bonded to an adjacent membrane, (d) means for establishing an electrical potential between the cathode electrode of the last cell in the unit and the anode of the first cell of the unit, (e) means for circulating an aqueous chloride solution to each of the anode chambers to electrolyze the chloride and produce chlorine at the anode electrodes.

(f) means to remove evolved chlorine from the anode chambers, (g) means to remove electrolysis products including hydrogen from the cathode chambers.

24. The electrolysis unit of claim 23 wherein the spaced elongated conductive projections on each bipolar element are angularly disposed to each other thereby establishing a plurality of individual membrane supporting areas at the points of intersection of the angularly disposed ribs located on opposite sides of a membrane.

25. The electrolysis unit of claim 23 in which the conductive bipolar elements are fabricated of graphite.

26. The electrolysis unit of claim 23 wherein a conductive elements is interposed between the spaced conductive projection of the bipolar elements and the electrodes bonded to the membrane.

27. The electrolysis unit of claim 26 wherein the interposed conductive elements are fluid permeable metallic screens.

28. A bipolar current collecting element comprising;

(a) a body of conductive material, (b) said body having recessed portions on opposite sides thereof, (c) a plurality of spaced conductive projections extending from the base of the recessed portion for establishing electrical contact between the body and electrodes on opposite sides thereof, (d) means communicating with each of the recessed portions to permit introduction and removal of fluids.

29. The bipolar current collecting element of claim 28 wherein the conductive body is fabricated of graphite and the spaced, conductive, projections in the recessed portions are angularly displaced with respect to each other.

30. The bipolar current collecting element of claim 29 wherein the spaced, conductive projection in the recessed portions are elongated, parallel ribs which define a plurality of fluid distributing channels.

31. The bipolar current collecting element of claim 30 wherein the elongated, parallel ribs on opposite sides of the current collecting element are tapered at the electrode contacting end.

* * * * *